United States Patent [19]

Gardner

[11] 4,068,793

[45] Jan. 17, 1978

[54] CUSHIONING INSERT

[75] Inventor: Jeffrey M. Gardner, Wheaton, Ill.

[73] Assignee: Container Corporation of America, Chicago, Ill.

[21] Appl. No.: 790,600

[22] Filed: Apr. 25, 1977

[51] Int. Cl.[2] ..... B65D 25/14

[52] U.S. Cl. ..... 229/14 C; 206/422

[58] Field of Search ..... 229/14 C; 206/418, 419, 206/422

[56] References Cited

U.S. PATENT DOCUMENTS

| | | | |
|---|---|---|---|
| 2,744,622 | 5/1956 | Sparks | 229/14 C X |
| 3,227,357 | 1/1966 | Knapp et al. | 229/14 C X |
| 3,294,226 | 12/1966 | McFarland et al. | 229/14 C X |
| 3,655,112 | 4/1972 | Jeffers | 229/14 C |
| 3,955,675 | 5/1976 | Kurtz | 206/419 |
| 3,971,472 | 7/1976 | Veenman | 229/14 C X |

*Primary Examiner*—Davis T. Moorhead
*Attorney, Agent, or Firm*—Carpenter & Ostis

[57] ABSTRACT

A cushioning insert for containers loaded with necked articles arranged in allochiral relationship such as video tubes having a large viewing surface and wall portions tapering toward the neck of the tube is disclosed. The insert is characterized by a base panel having upstanding walls from which panel supports for the tube are provided. The wall and base panels have panel portions cut therefrom at the lines of fold between such panels and such panel portions are constructed and arranged to provide a stable structure supporting the tube necks.

9 Claims, 7 Drawing Figures

CUSHIONING INSERT

BACKGROUND OF THE INVENTION

The invention herein has for its main purpose the protection of frangible articles of commerce such as video tubes. By reason of their configuration and for economy in packaging, it is desirable to dispose them in allochiral relationship, at the same time without sacrificing the protection of the articles.

THE DRAWINGS

Figure 1:
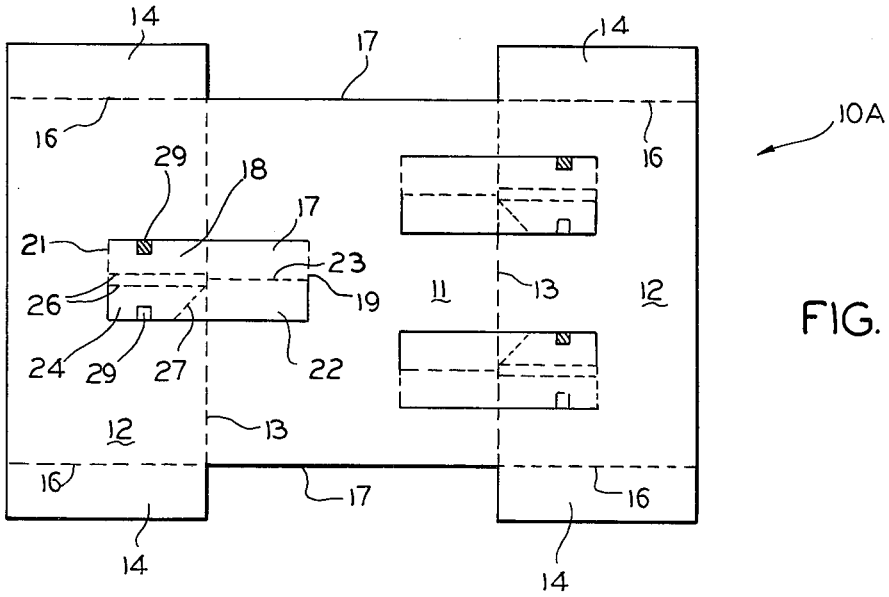
FIG. 1 is a plan view of a cut and scored blank for forming a cushioning insert according to the present invention.
Figure 2:
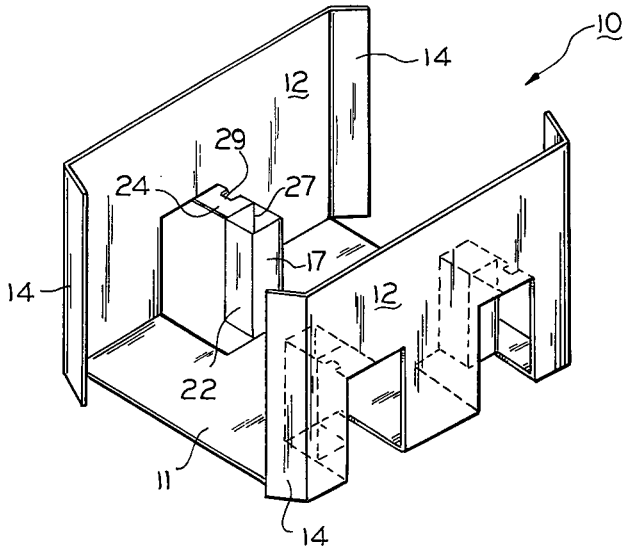
FIG. 2 is an isometric view showing the insert in erected position.

The improved cushioning insert according to the present invention is denoted generally by the reference numeral 10 and is formed from a blank of paperboard or the like 10A. The cushioning insert 10 seen in the several views is adapted to enclose a plurality of video tubes VT having a viewing surface VS and sides TS tapering therefrom to a neck N.

Blank 10A has a base panel 11 with opposed wall panels 12 foldably connected thereto along spaced fold lines 13. The ends of the wall panels 12 have end flaps 14 foldably connected thereto along score lines.

Figure 7:
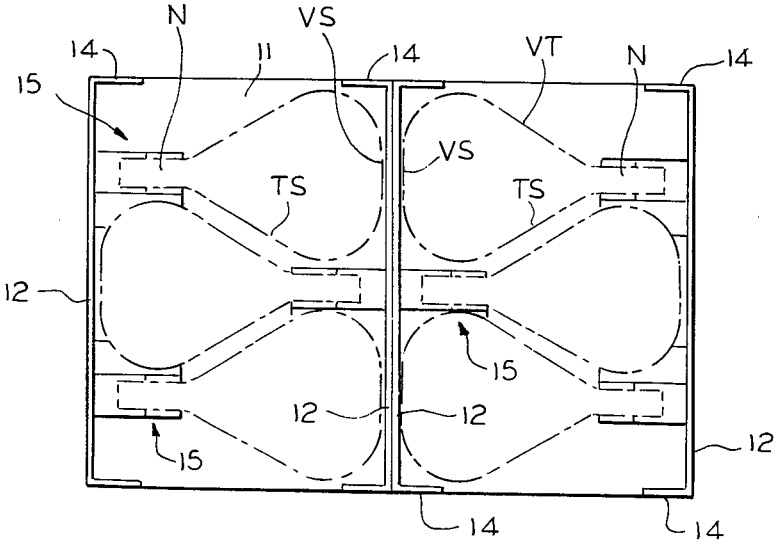
FIG. 7 is a plan view showing the manner in which a pair of loaded inserts may be placed in side-by-side arrangement.

As seen particularly in FIG. 7, each of the necks N rests upon a support indicated generally by numeral 15, one of the walls 12 having a central suppot 15 while the other wall has spaced supports 15, so that the tubes VT may be disposed within the insert 10 in allochiral relationship.

Each of the supports 15 comprises a wall portion 17 foldable along a score line 19 in base panel 11, and a second wall portion 18 foldable along a score line 21 in wall 11, the two wall portions 17 and 18 being foldably joined by a portion of score line 13.

Figure 3:
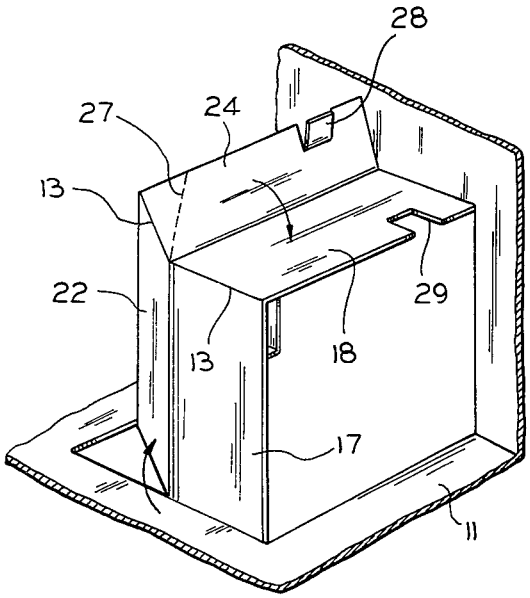
FIG. 3 is a detailed isometric view showing the forming of a support for the neck of a video tube.
Figure 4:
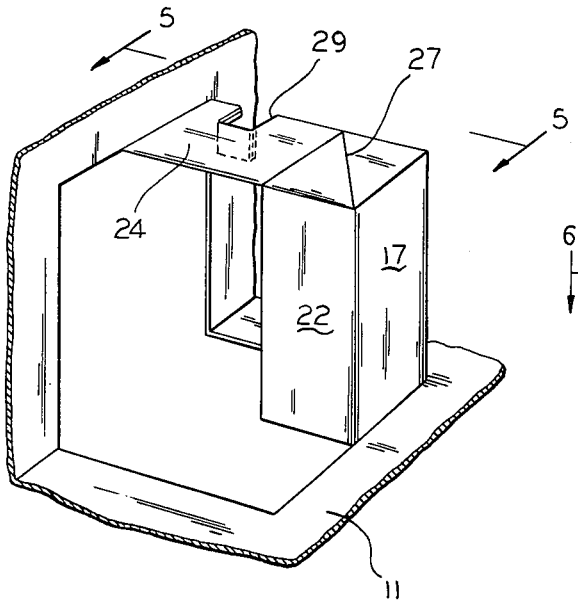
FIG. 4 is an isometric view showing the manner in which the support is formed.
Figure 5:
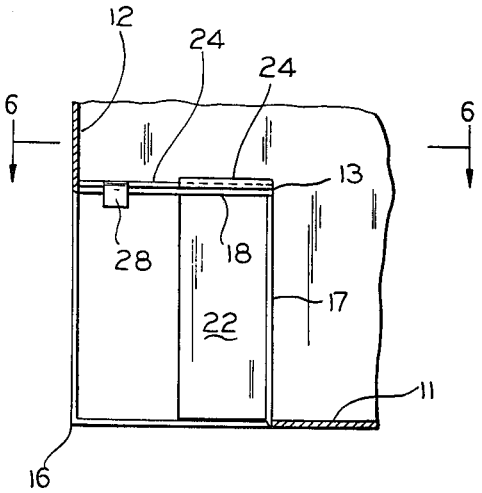
FIG. 5 is a view looking in the direction of arrows 5—5 of FIGS. 4 and 6.
Figure 6:
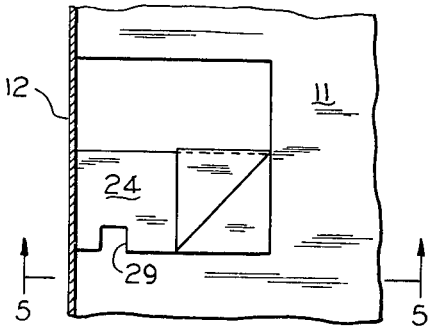
FIG. 6 is a plan view showing elements for forming the support of FIGS. 3 and 4.

When the wall 12 is erected with respect to base panel 11, portions 17 and 18 adopt the erected positon seen in FIGS. 3 and 5.

Structure is provided for locking the erected wall portions 17 and 18 in position, and wall portion 17 is hingedly connected to locking flap 22 along a fold line 23. Wall porton 18 is similarly connected to a locking flap 24 along closely spaced fold lines 26.

When wall portion 17 is erected, flap 22 is turned in a direction as seen in FIG. 3, and locking flap 24 turned as seen in said figure to lie against wall portion 18, this being accommodated by a diagonal score 27 in flap 24.

The locking in position of the support 15 is completed by a locking tab 28 in flap 24 which engages a locking slot 29 in portion 18.

As seen in FIG. 7, the two container liners 10 when loaded in side-by-side arrangement, may be placed into a shipping container, not shown.

I claim:

1. A cushioning insert for shipping containers for a plurality of necked articles of commerce such as a television picture tube having a wide screen at one end and a narrow neck at the other end, said articles being arranged in allochiral relationship, said insert being formed from a cut and scored blank of paperboard or the like, and comprising:

a. a base panel having a pair of wall panels foldably joined to and upstanding from opposed edges thereof;

b. one of said wall panels and a portion of said base panel, adjacent a line of fold therebetween, having cut and scored portions erectable to define a support for the neck of one of said articles;

c. the other of said wall panels and said base panel having spaced portions of said base panel and spaced portions of said other wall panel adjacent a line of fold between said base panel and said other wall panel, having cut and scored portions erectable to define spaced supports, each for support of the neck of another one of said articles;

d. structure for locking each of said supports in position comprising locking flpas foldably connected to said panel portions and to each other and cut from said base panel and a correlative wall panel;

e. one of said locking flaps overlying the panel portion formed from a wall panel, and having a diagonal score line therein to provide folding of said locking flap over the panel portion formed from a wall panel.

2. The insert, according to claim 1, wherein the other of said locking flaps is foldable into position upon folding of said one locking flap into position to stiffen the panel portion erected from said base panel.

3. The insert, according to claim 1, wherein said one locking flap is provided with a locking tab folded into locking engagement with a locking notch in the panel portion formed from said wall panel.

4. A cushioning insert for shipping containers for at least one of necked articles of commerce such as a television picture tube having a screen at one end and tapering toward the neck at the other end, said insert being formed from a cut and scored blank of paperboard or the like, and comprising:

a. a base panel having a wall panel upstanding therefrom at a line of fold between said base panel and said wall panel;

b. said wall panel and said base panel having cut and scored portons adjacent to a line of fold erectable to define a support for the neck of said article;

c. structure for locking said support in position comprising locking flaps foldably connected to said panel portions and to each other, and cut from said base panel and said wall panel;

d. one of said locking flaps overlying the panel portion formed from said wall panel and having a diagonal score line therein to provide folding of said locking flap over the panel portion formed said wall panel.

5. The insert, according to claim 4, wherein the other of said locking flaps is foldable into position upon folding of said one locking flap into position to stiffen the panel portion erected from said base panel.

6. The insert, according to claim 4, wherein said one locking flap is provided with a locking tab folded into locking engagement with a locking notch in the panel portion formed on the wall panel.

7. An insert, formed from a unitary blank of paperboard, for supporting and cushioning, within an outer shipping container, a frangible article such as a television picture tube having at one end a wide screen and at the other end a narrow neck, said insert comprising:

a. a bottom wall and a side wall foldably joined to each other at corresponding edges thereof;

b. a support for the neck of said article formed from material cut from adjacent areas of said walls: the portion of the support cut from said side wall being parallel to said bottom wall, and the portion of the support cut from said bottom wall being parallel to said side wall;

c. said portons being foldably joined to the respective walls from which they are cut and being foldably joined to each other;

d. the portion cut from one of said walls having a pair of sections foldably joined to each other and scored to permit one section to be folded over on to the other section to provide additional rigidity for said support.

8. An insert, according to claim 7, wherein one of said sections has a notch formed therein while the other of said sections has a tab cut therefrom and receivable in said notch.

9. An insert, according to claim 7, wherein one of said sections is formed with a diagonal fold line to permit folding of said section over said other section.

* * * * *